US006481424B2

(12) United States Patent
Bircann et al.

(10) Patent No.: US 6,481,424 B2
(45) Date of Patent: Nov. 19, 2002

(54) VALVE SHAFT SCRAPER AND FILTER FOR PREVENTING COKING

(75) Inventors: Raul Armando Bircann, Penfield, NY (US); Dwight Orman Palmer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/836,847

(22) Filed: Apr. 17, 2001

(65) Prior Publication Data

US 2002/0148452 A1 Oct. 17, 2002

(51) Int. Cl.[7] ..... F02M 25/07

(52) U.S. Cl. ..... 123/568.11; 123/568.23; 123/568.26

(58) Field of Search ..... 123/568.21, 256.24, 123/568.26, 568.11; 251/129.11, 129.15

(56) References Cited

U.S. PATENT DOCUMENTS 6,330,880 B1 * 12/2001 Okada et al. ..... 123/568.2

FOREIGN PATENT DOCUMENTS

JP WO99/43942 * 9/1999

* cited by examiner

*Primary Examiner*—Gene Mancene
*Assistant Examiner*—Arnold Castro
(74) *Attorney, Agent, or Firm*—Patrick M. Griffin

(57) ABSTRACT

A valve shaft scraping and filtering device for use in an engine valve includes a woven mesh annulus disposed within a valve assembly and surrounding the valve shaft such that the annulus gently scrapes the valve shaft as the valve shaft reciprocates within the valve assembly without interfering with shaft actuation. The annulus may be made with a high density weave and utilized as a filter or particulate seal to trap loose particulates which may be present within the valve.

9 Claims, 2 Drawing Sheets

VALVE SHAFT SCRAPER AND FILTER FOR PREVENTING COKING

TECHNICAL FIELD

This invention relates to vehicle engine valves, and in particular to a scraping and filtering device for reducing contaminant build-up on a valve shaft.

BACKGROUND OF THE INVENTION

It is known in the art relating to vehicle engine valves that some valve designs are particularly susceptible to contaminant built-up on the valve shaft. One such design is the exhaust gas recirculation (EGR) valve, which selectively adds a partial flow of exhaust gas into the intake manifold of a vehicle to mix with fresh intake air to lower the combustion temperature thereby decreasing exhaust emissions.

EGR valves generally include a valve assembly, connected with a solenoid actuator assembly, operable to close or open a passage between the intake and exhaust manifolds. The valve assembly includes a valve member including a valve shaft supported by a bearing for reciprocating motion along a central axis on which a valve body is aligned.

EGR valves are designed so that the clearance between the shaft and the bearing is as small as practicable without interfering significantly with valve actuation so as to minimize leakage of exhaust gas. However, the need to minimize gas leakage is balanced against the need to minimize hysteresis (and thus enhance actuator performance) which requires the diametral clearance between the valve shaft and its supporting bearing to be as large as possible (i.e. large enough to permit only an acceptable amount of exhaust gas leakage, less than 0.5 g/s, while limiting moisture intrusion).

In operation, the valve shaft is selectively exposed to exhaust gas as it operates to selectively admit exhaust gas into the valve assembly. Because exhaust gas (particularly diesel exhaust gas) has a high moisture content and is laden with particulates, the valve shaft may become coked, and the coking drawn into the bearing when the valve is closed. The accumulation of contaminants on the surfaces of the valve shaft and bearing may ultimately cause the shaft to seize in the bearing. It is therefore desirable to provide a simple, cost-effective means for removing contaminant build-up on a valve shaft.

Additionally, some engine designs are impractical to completely rid of debris prior to assembly. In such cases, loose debris can lodge between the valve shaft and its bearing rendering the valve inoperable. It is therefore desirable to provide a means for filtering or collecting loose debris where engine cleanliness prior to assembly is problematic.

SUMMARY OF THE INVENTION

The present invention provides a valve shaft scraper and filter for cleaning the shaft of a valve assembly to prevent coking and failure of the valve. The valve shaft scraper and filter is an annulus of woven metal mesh disposed within a cavity in the valve assembly to surround the valve shaft. As the valve shaft reciprocates through the valve assembly, it passes through the annulus which gently scrapes against the outer surface of the valve shaft to remove contaminant build-up on the shaft. To this end, the annulus has the closest diametral relationship possible with the valve shaft while enjoying a limited range of axial and radial movement within the cavity so as neither to compromise operation of the actuator on the shaft nor impart hysteresis on the shaft.

These and other features and advantages of the invention will be more fully understood from the following description of certain specific embodiments of the invention taken together with the accompanying drawings.

DESCRIPTION OF THE PREFERRED EMBODIMENT

Figure 1:
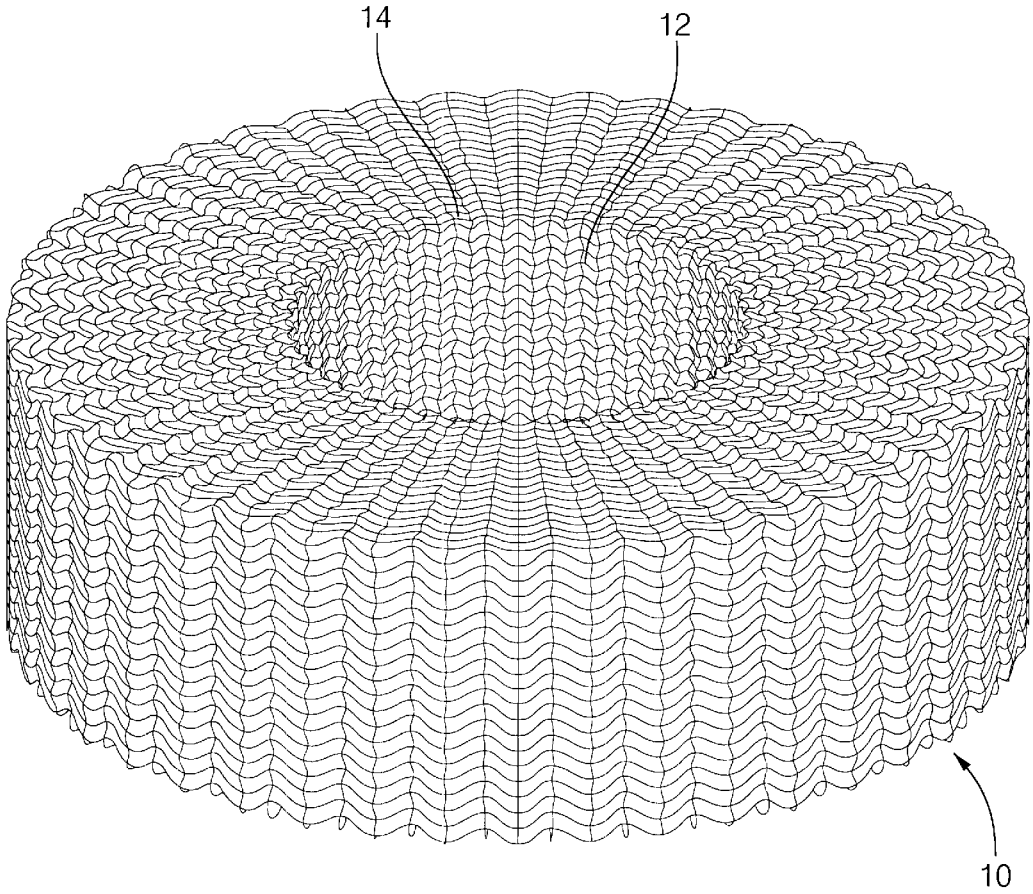
FIG. 1 is an enlarged perspective view of a valve shaft scraper and filter in accordance with the present invention.

Referring now to the drawings in detail, numeral 10 generally indicates the annulus of the present invention. The annulus 10 is preferably made of a woven metal material mesh and has an inner surface 12 defining an aperture 14. Suitable woven mesh is readily available from manufacturers including Metex Corporation of Edison, New Jersey, USA.

Figure 2:
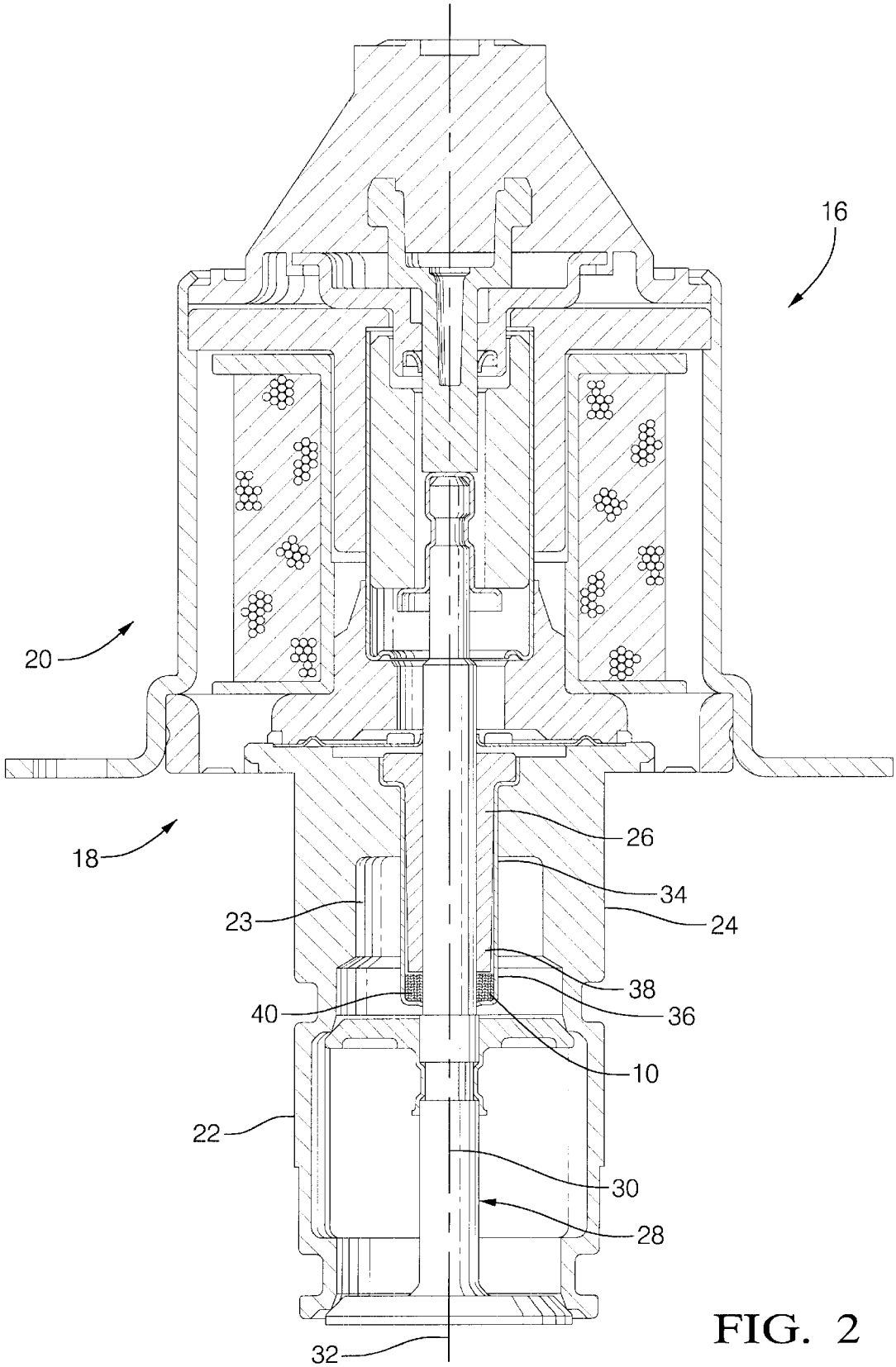
FIG. 2 is an elevational cross-sectional view of a diesel EGR valve incorporating a valve shaft scraper and filter in accordance with the present invention.

FIG. 2 shows a diesel EGR valve 16 having a valve assembly 18 coupled to a solenoid actuator 20. The valve assembly 18 includes a valve body 22 having a generally cylindrical form defining an internal passage 23 for the. passage of exhaust gas through the valve 16. The valve body 22 further includes a mounting portion 24 that connects the valve assembly 18 to the solenoid actuator 20 and carries a shaft bearing 26.

Valve assembly 18 further includes a valve member 28 including a shaft 30 supported by the bearing 26 for reciprocating motion along axis 32 on which the cylindrical valve body 22 is aligned.

Mounted between the mounting portion 24 and the bearing 26 is a retainer 34 having a lower portion 36 that extends below the lower end 38 of the bearing 26 to define an annular cavity 40 within which the annulus 10 floats. Hence, the cavity 40 is sized to permit limited radial and axial movement of the annulus 10 (in the range of ±0.2 mm) without constraining the reciprocating motion of the valve shaft 30.

Valve shaft 30 is in intimate diametral relationship with annulus 10 such that as the shaft 30 reciprocates through the valve body 22, it passes through the aperture 14 of the annulus where it makes gentle contact with the inner surface 12 of the annulus. The inner surface 12 of the annulus scrapes contaminants from the valve shaft 30 but does not interfere with actuation of the shaft 30.

The annulus of the present invention may be further modified to function as a particulate seal. In such an application, the annulus would be made from a higher density woven mesh material suitable for trapping or filtering loose particulates which may be present in the engine valve shaft, preventing them from becoming lodged between a valve shaft and its bearing. An annulus made with such higher density weave is not necessarily a prerequisite to achieve adequate scraping of the valve shaft, however.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A valve shaft scraping and filtering device for use in an engine valve including a valve shaft reciprocable within a valve assembly, comprising:

a woven mesh annulus disposed within said valve assembly and surrounding said valve shaft such that the annulus gently scrapes the valve shaft as the valve shaft reciprocates within the valve without interfering with shaft actuation.

2. The valve shaft scraping and filtering device of claim 1, wherein said annulus floats within a retainer mounted within the valve assembly and surrounding the shaft.

3. The valve shaft scraping and filtering device of claim 1, wherein said annulus has a weave density sufficient to inhibit loose debris from collecting on the valve shaft.

4. The valve shaft scraping and filtering device of claim 1, wherein the annulus is metal.

5. The valve shaft scraping and filtering device of claim 1, wherein the annulus is floatable within a cavity within said valve assembly in both the axial and radial directions.

6. An EGR valve for use in an engine, comprising:

a valve body defining an internal passage for the passage of exhaust gas through the valve;

a bearing supported in the passage;

a valve member movable in the valve body for controlling exhaust gas flow through the passage, the valve member including a shaft supported for reciprocating motion in the bearing;

a retainer in the passage and surrounding an end of the bearing; and a woven mesh annulus disposed within the retainer and surrounding the valve shaft at the end of the bearing such that the annulus gently scrapes the valve shaft as the valve shaft reciprocates within the valve body without interfering with shaft actuation.

7. The EGR valve of claim 6, wherein said retainer defines a cavity and said annulus is floatable within the cavity in both the axial and radial directions.

8. The EGR valve of claim 6, wherein said annulus has a weave density sufficient to inhibit loose debris from interfering with the reciprocating motion of the valve shaft within the bearing.

9. An EGR valve for use in an engine, comprising:

a valve movable within a valve assembly for controlling exhaust gas flow through said valve assembly, said valve including a shaft reciprocable within said valve assembly; and a woven mesh annulus disposed within said valve assembly and surrounding said valve shaft such that the annulus gently scrapes the valve shaft as the valve shaft reciprocates within the valve assembly without interfering with shaft actuation.

* * * * *